United States Patent [19]

Frei

[11] 4,334,572

[45] Jun. 15, 1982

[54] VENETIAN BLIND CONSTRUCTION

[75] Inventor: Paul Frei, Elgg, Switzerland

[73] Assignee: Griesser AG, Switzerland

[21] Appl. No.: 210,625

[22] Filed: Nov. 26, 1980

[30] Foreign Application Priority Data

Jan. 24, 1980 [CH] Switzerland ..... 559/80

[51] Int. Cl.[3] ..... E06B 9/30

[52] U.S. Cl. ..... 160/170

[58] Field of Search ..... 160/170, 171

[56] References Cited

U.S. PATENT DOCUMENTS

| | | | |
|---|---|---|---|
| 2,381,060 | 8/1945 | Kahn | 160/170 |
| 2,723,010 | 1/1956 | Griesser | 160/170 |
| 3,260,302 | 7/1966 | Griesser | 160/170 |
| 3,439,726 | 4/1969 | Lageson | 160/170 |

*Primary Examiner*—Peter M. Caun

*Attorney, Agent, or Firm*—McGlew and Tuttle

[57] ABSTRACT

A venetian blind comprises a windup drum for a lifting strap firmly fitted to a drive shaft. Lateral hub portions of a drum are provided with teeth which serve as contact surfaces for two setting straps. Supporting twines for tiltable slats are suspended from the setting straps whose both ends are connected to the associated one of the other strap by connecting plates which act as stop members. Bearing brackets of the drive shaft, accommodated in a supporting housing of the blind, are provided at their bottom with guide webs, for the setting straps and the lifting strap. Stop lugs provided on a bearing bracket in the housing, cooperate on one side with the connecting plate and on the other side with an engaging member of setting strap. During lifting of the blind, the lugs limit the open position of the straps, and during lowering of the blind, they set the predetermined oblique position of the slats. Pawls, which are radially displaceable in the windup drum, cooperate with the engaging member to close the slats if lifting strap is in its wound-off position. To secure the slats against wind action, i.e. in their open position against closing, or in a predetermined position against further opening, lock cams cooperating with teeth portions of the drum are provided on setting straps.

10 Claims, 6 Drawing Figures

Fig. 5
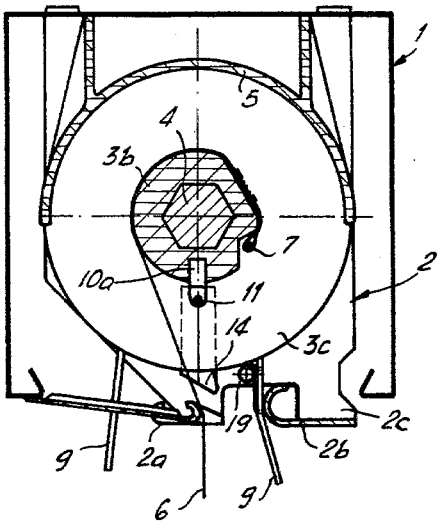
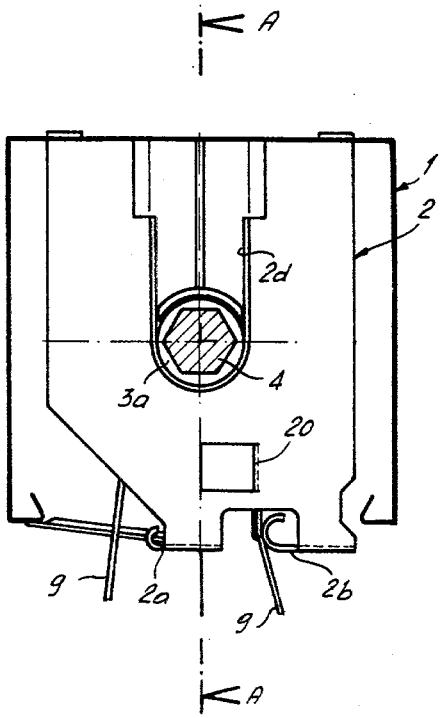
Fig. 6

VENETIAN BLIND CONSTRUCTION

FIELD AND BACKGROUND OF THE INVENTION

The present invention relates in general to venetian blind constructions and, in particular to a new and useful venetian blind construction which includes mechanisms for setting the blinds at particular angles when the venetian blind is opened or closed.

Prior art venetian blinds are usually designed so that, by turning the drive shaft to lift the slats (gathering), the slats are mostly pivoted into a substantially horizontal, open position, while a turning in the opposite direction causes their pivoting into a mid position between open and closed, (e.g. 45° ) which is frequently called the working position. A fully closing position (substantially vertical) of the slats is to be reached only upon completely lowering the blind. Prior art constructions of this kind are mostly complicated and therefore, susceptible to mechanical problems. Since the setting straps form a non-positive slipping clutch with the surfaces they contact, fully or partly open slats may easily be misadjusted, for example by the action of the wind. Frequently the arrangement is such that upon winding off the last turn from the wind-up drum, the lifting strap releases a spring loaded coupling member intended to cause the slats to pivot into their closing position. Prior art designs of this kind have the disadvantage that, for example, the slats come to rest upon an obstacle, any slackening of the setting strap on the drum leads to an undesirable premature release of the coupling member. With a further mechanical drive of the blind a mostly unavoidable overrun of the motor may cause the coupling member, in an effective position, to move farther, which may result in damage.

SUMMARY OF THE INVENTION

The present invention is directed to a venetian blind of the above kind in which the mentioned disadvantages of the prior art construction are avoided with the aid of means which are particularly simple in manufacture, assembly, handling, and operation.

Accordingly, an object of the present invention is to provide a venetian blind construction comprising a housing, a drive shaft mechanism rotatably mounted in the housing, a lifting strap connected to the drive shaft mechanism and windable thereon with rotation of the drive shaft mechanism, a bottom rail connected to the lifting strap which is lifted with winding of the lifting strap on the drive mechanism, at least one setting strap wrapped in coupling contact with the drive shaft mechanism with opposite ends of the setting strap connected to the bottom rail, at least one slat connected to the setting strap on opposite sides of the drive shaft mechanism, the setting strap being movable by rotation of the drive shaft mechanism to tilt the slat, first and second stop lugs connected to the housing, first and second spaced stop members connected to the setting strap, the first stop member abutting the first stop lug with rotation of the drive shaft mechanism to wind and lift the lifting strap, to move the setting strap and to bring the slat into a first position, the second stop member abutting the second stop lug with rotation of the drive shaft mechanism in an opposite direction to unwind and lower the lifting strap to move the setting strap and bring the slat into a second position, and a stop release mechanism connected to the drive shaft mechanism and operable with a full unwinding of the lifting strap to release the second stop member from the second stop lug to permit further movement of the setting member and further movement of the slat.

Another object of the invention is to provide a venetian blind construction as outlined above which also includes a cam lock connected to the setting strap which engages the drive shaft mechanism to stop movement of the setting strap when there is no movement of the drive shaft mechanism.

This construction ensures that the slat or slats are positively moved, during the lifting of the blind, into their first or open position, and during the lowering of the blind, into their mostly used second or oblique position of about 45°, and also that, due to the additional stop or cam lock provided on the setting strap, their set position cannot be changed by an undesired influence from the outside, for example, of the wind.

Further, the stop release mechanism, which has a spring loaded panel, which directly engages the second stop member, reliably effects the closing of the slat into its third position. A particular advantage of such stop members on the setting straps is that they become effective by the motion of the strap alone, i.e. need not perform any motion of their own relative to the straps. This results in a particular simple and reliably operating construction.

In a particularly advantageous embodiment, a reset member is provided on the supporting housing, in the path of motion which is followed by the pawl in effective position, by which member the pawl is pushed back into its ineffective position as soon as, for example, the drive shaft is further rotated (such as by an overrunning motor) even without winding up the lifting strap. Such a reset member is also advantageous if for example, during the lowering, the blind is checked at the bottom by an obstacle and the turns of the still wound up lifting strap become loose to an extent that the pawl is untimely brought into its effective position.

A further object of the invention is to provide a venetian blind construction which is accordingly simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

FIG. 5 is a vertical sectional view taken along the line C—C of FIG. 1 and;

FIG. 6 is a vertical sectional view taken along the line D—D of FIG. 1.

DESCRIPTION OF THE PREFERRED EMBODIMENT

Figure 1:
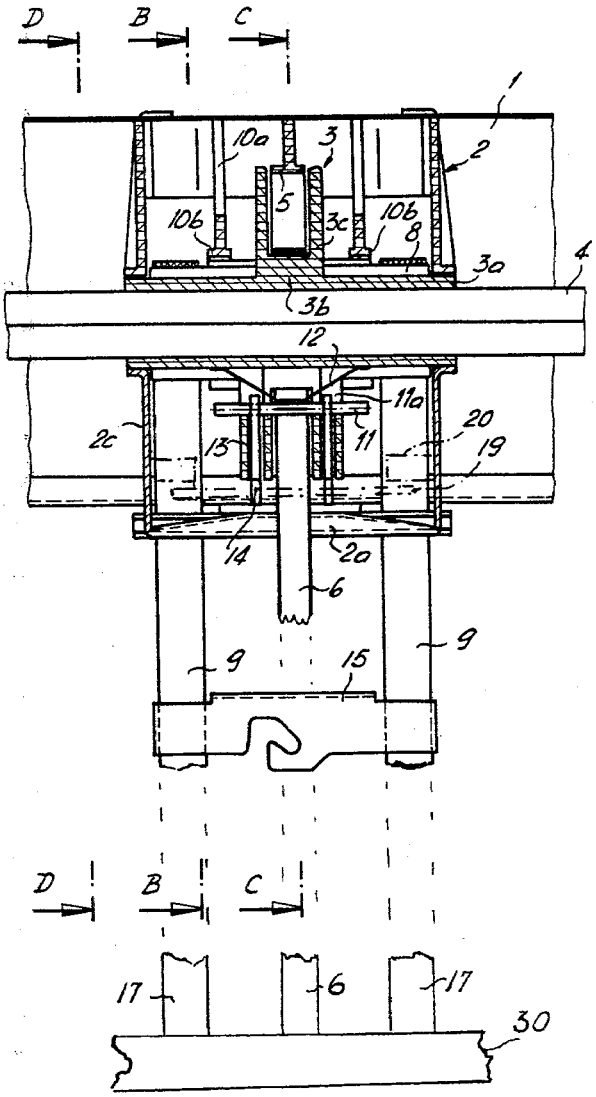
FIG. 1 is a vertical axial sectional view of a mechanism according to the invention taken along the line A—A of FIG. 6.
Figure 2:
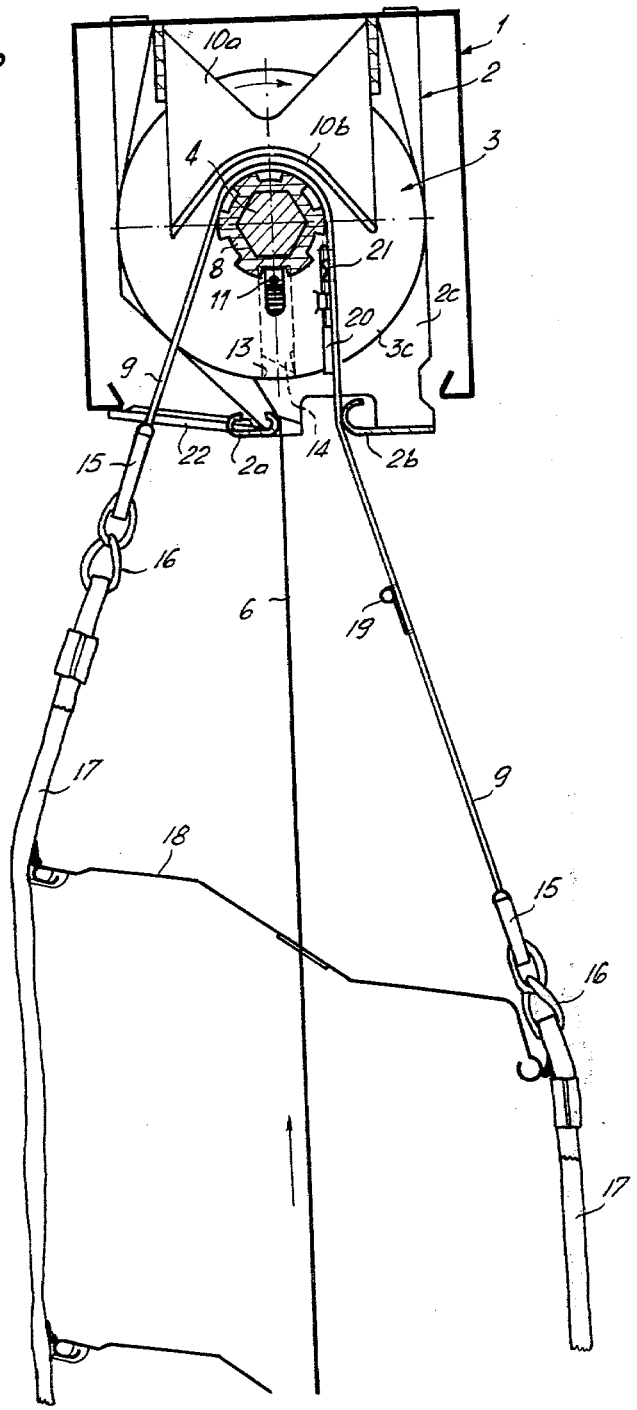
FIGS. 2,3,4, are vertical sectional views taken along the line B—B of FIG. 1, with the slats in different positions.
Figure 3:
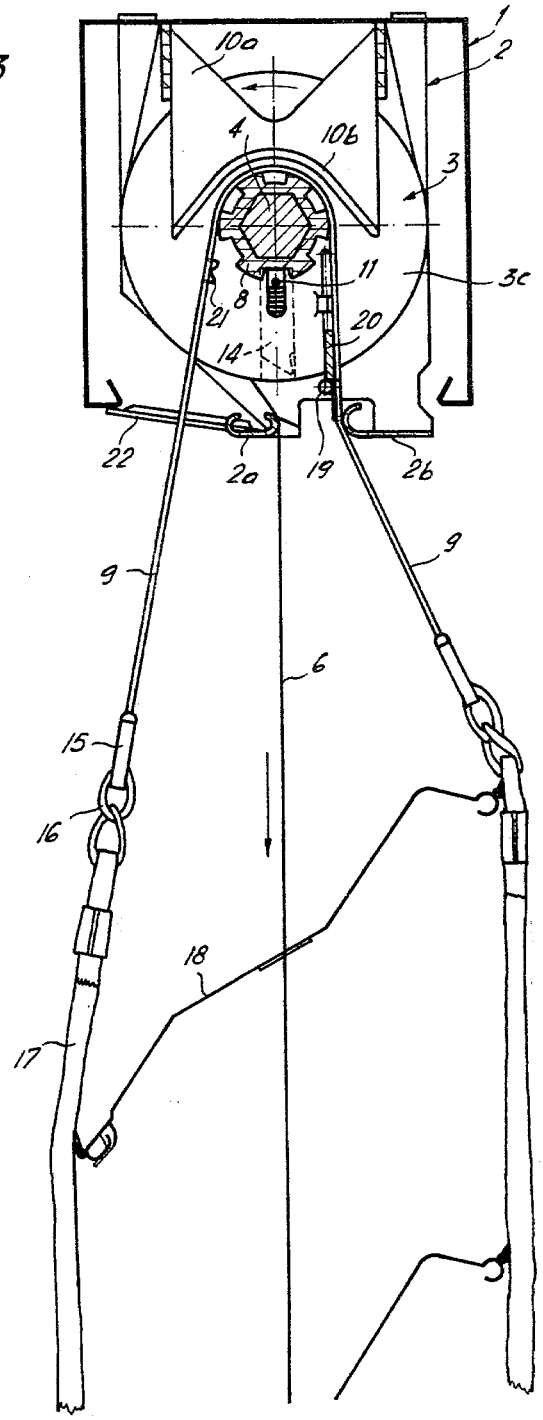
Figure 4:
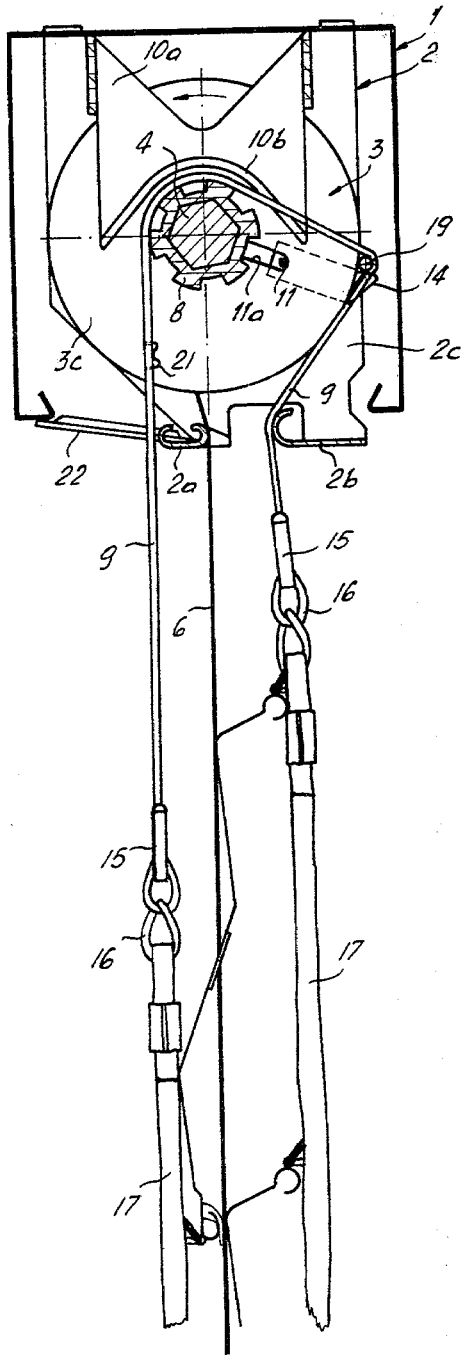

Referring now to the drawings in particular, the invention embodied therein, in FIG. 1 comprises a venetian blind having a conventional U-section supporting housing 1 which opens downwardly. Brackets 2 are secured to housing 1 at axially spaced locations. Brackets 2 are each formed by two cross walls 2*c* which are connected to each other by bottom webs 2*a*, 2*b* (see FIG. 2). Cylindrical end portions 3*a* of a hub of a wind-up drum 3 are supported in upwardly open recesses 2*d* of cross walls 2*c*. End portions 3*a* firmly receive a hexagon drive shaft 4 (see FIG. 6). Drive shaft 4 is drivable in a conventional manner (not shown), either through a transmission by a hand crank, or by an electric motor. A winding channel of drum 3 which is defined by discs 3*c*, is covered by a top strip 5, to prevent the windings of the textile lifting strap 6 from drifting out of the channel. Lifting strap 6 is fixed to the drum core 3*b* by means of conventional retaining pin 7 (see FIG. 5). Strap 6 lifts bottom rail 30 to which it is connected in known fashion. Between the drum core 3*b* and cross walls 2*c*, the lateral hub portions of windup drum 3 are provided with teeth 8 formed by circumferentially arranged elongated grooves as shown in FIGS. 2,3 and 4. In the area adjacent each of the cross walls 2*c*, the cylindrical envelopes of the grooves serve as contact surfaces for setting straps 9 which are made of textile material. The grooves thus form slipping clutches for the straps 9. The inside areas of the hub portions 3*a*, which are not embraced by setting straps 9, are covered by reset cam structures 10*b* whose function will be explained later. A pin 11 is provided in a groove 11*a* which is defined in drum core 3*b* and extends radially into discs 3*c*. This is shown in FIG. 4. Pin 11 projects beyond discs 3*c* on both sides as seen in FIG. 1. A leaf spring 12 biasing pin 11 in the radially outward direction, is provided between the pin 11 and the bottom of the groove near portions 3*a*. The arrangement is such that with the lifting strap 6 wound up, pin 11 is received in groove 11*a* in a position flush with the bottom of the winding channel. As shown in FIG. 1, those portions of discs 3*c* defining the winding channel, where 11*a* is provided, are thicker. Each of these disc portions is provided with radial recesses 13 having a rectangular cross section and extending in alignment with grooves 11*a* substantially up to the bottom of the longitudinal grooves of the hub portions of drum 3. Each of the portions of pin 11 extending over recesses 13 carries a pawl 14 which is guided in the respective recess 13. Pawls 14 are of such length that, with lifting strap 6 wound up, they are completely immerged in the respective disc portion 3*c* (FIGS. 2,3) while with the lifting strap 6 wound off or unwound they project beyond the circumference of discs 3*a* (due to the action of spring loaded pin 11) as shown in FIGS. 1, 4 and 5.

The setting straps 9, which pass around the two hub portions of drum 3 provided with teeth 8, are connected to each other at their ends by a connecting plate 15 (FIG. 1). Advantageously, as shown, supporting members 17 (FIG. 2) for slats 18, formed by twines for example, are suspended from these two end plates 15 by means of chain links 16. An engaging member 19 is attached to the inside of setting straps 9 and connects the two straps. Engaging member 19 cooperates with teeth 8 of the respective hub portions of drum 3. As shown, bottom web 2*a* on both sides and bottom web 2*b* on its inside, are formed with upwardly bent edges serving as slide guides for setting straps 9 and lifting strap 6 respectively. At the underside of cross walls 2*c*, in the zone of bottom web 2*a*, stop lugs 22 are provided, cooperating with connecting plate 15 by which setting straps 9 are connected to each other on the respective outside of the blind. Plate 15 thus acts as a first stop member on first stop lug 22.

The blind operates as follows:

It is assumed that the individual parts of the blind are in their positions as shown in FIG. 2, i.e. with the drive shaft 4 about to be rotated clockwise and lifting straps 6 being wound up by at least one full turn. In this phase, lifting strap 6 has been effective to retract pawls 14 through pin 11 into discs 3*c*, while setting straps 9, which have been taken along in a clockwise direction by the contact surfaces of the drum hubs, are in a first position in which slats 18 are set open i.e. into a plane forming about 30° with the horizontal, with their front edges slightly higher than their rear edges. Since, in this position, outer connecting plate 15 of setting straps 9 applies on stop lug 22, a further clockwise turning of drive shaft 4 cannot take setting straps 9 along to enlarge the angle of inclination of slats 18. Therefore, the hub portions 3*a* with teeth 8 of the wind-up drum 3 slip beneath straps 9. At the same time, as shown in FIG. 2, lock cam 21 is just in a position closely adjacent the end of the inner section of setting straps 9 running off the toothed hub portion 3*a*. Should slats 18 be loaded, for example by the wind, in the closing direction (pivoting counterclockwise according to FIG. 2), lock cam 21 on the inside of straps 9 would instantly engage the next groove between teeth 8 of the hub portion. However, since windup drum 3 is secured against rotation (through transmission or motor) on self-locking drive shaft 4, a further motion of the setting straps 9 in the direction of closing slats 18, which would be caused by the wind, is prevented.

If now it is desired to lower the blind from the lifted position shown in FIG. 2, drive shaft 3 is rotated counterclockwise as viewed in FIG. 3. Due to the friction between setting straps 9 and teeth 8 of the hub portions of windup drum 3, this instantly takes setting straps 9 along counterclockwise and slats 18 are pivoted in the closing direction i.e. beyond their horizontal position. To additionally insure this taking along motion caused by friction alone, a leaf spring, pressing setting straps 9 from above into contact with the hub portions over which they run, might be provided. As shown in FIG. 3, the taking along of setting straps 9 ends as soon as engaging member or second stop member 19 butts from below against a second stop lug 20 of cross walls 2*c*. At that time, lock cams 21, which support the motion of setting straps 9 by engaging between teeth 8, have passed the hub portions 3*a*. After slats 18 have reached a median inclined or second position (preferably of about 45° relative to the horizontal), lock cams 21 have just arrived at the toothed hub portions of windup drums 3, as shown in FIG. 3. Setting straps 9, engaging member 19, and lock cams 21, as well as slats 18 remain in these positions until the blind is almost completely lowered. Now, with the drive shaft 4 stopped, lock cams 21 still prevent slats 18 from pivoting back into their open position, for example, under the action of the wind.

In this lowered position of the blind, with inclined slats 18, lifting strap 6 is still wound about drum core 3*b* by a last turn. This turn, which is stressed by the weight of the blind, retains pin 11 and pawls 14 against the action of leaf spring 12 in their radially inner end positions in which pawls 14 are completely retracted in discs 3*c*. If it is now desired to close slats 18 completely (FIG. 4), lifting strap 6 is entirely wound off by further turning drive shaft 4 in the (counterclockwise) lowering direction of the blind. This releases pin 11 which is then pushed in recess 11*a* radially outwardly, by leaf spring 12. Consequently, pawls 14 now project radially beyond the rim of discs 3*c* as shown in FIG. 4. If drive shaft 4 is further turned, pawls 14 force engaging member 19 out of engagement with stop lug 20, while at the same time the setting strap section carrying rear twines 17 is pushed out of its instaneous stretch position, whereby the rear twines 17 are pulled upwardly through a corresponding distance and slats 18 are closed or moved into a third position. In designs where shaft 4 is driven through a crank, an end stop (not shown) may be provided in supporting housing 1 preventing an overwinding beyond the end position of engaging member 19 given by the closed position of slats 18.

While lowering the blind, it may happen that the end rail butts against an obstacle. With a further lowering rotation of drive shaft 4, lifting strap 6 is further wound off. This may loosen the turn remaining in the drum channel to such an extent that leaf spring 12 can push pawls 14 through pin 11 radially outwardly into a position in which the pawls become effective. On the other hand, if an electric motor is provided for driving shaft 4, and slats 18 are moved into their closed or third position shown in FIG. 4, an overrun of the motor, thus moving of pawls 14 beyond their desired end position, can hardly be prevented, wherefore a fixed end stop for the engaging member must not be provided. In both these mentioned cases, reset cam structure 10*b* covering the circumference of the hub portions not engaged by setting straps 9, at a small distance and through an angle of slightly over 180°, provide a remedy. If pawls 14 in their effective extension move beyond their end position shown in FIG. 4, the end portions of pin 11 carrying pawls 14 butt against the associated reset cam structure 10*b*, and the pin is pushed radially inwardly thereby, with the continuing rotation of drum 3, pawls 14 are forced to return to their ineffective position and are prevented from entraining engaging member 19 and straps 9 upwardly.

The inventive blind not only ensures a satisfactory setting and keeping of the slats in the desired position, but also secures them against wind action, in any position between the open and the predetermined oblique one, due to the cooperation of the toothed portion 8 with cams 21. The closing of the slats is particularly secure which is needed, for example, to black out the room, because a positive engagement between engaging member 19 and pawls 14 is provided (in contradistinction to the frictional engagement through a slipping clutch), and mechanical problems or damage which might be caused by an unsatisfactory function of such a positive engagement, are avoided.

While a specific embodiment of the invention has been shown and described in detail to illustrate the application of the principles of the invention, it will be understood that the invention may be embodied otherwise without departing from such principles.

What is claimed is:

1. A venetian blind construction comprising:

a housing;

drive shaft means rotatably mounted in said housing;

a lifting strap connected to said drive shaft means and windable thereon with rotation of said drive shaft means;

a bottom rail connected to said lifting strap which is lifted with winding of said lifting strap on said drive shaft means;

at least one setting strap in coupling contact with and wrapped over said drive shaft means having ends connected to said bottom rail;

at least one slat connected to said setting strap on opposite sides of said drive shaft means;

said setting strap being moved by rotation of said drive shaft means to tilt said slat;

first and second stop lugs connected to said housing;

first and second spaced stop members connected to said setting strap;

said first stop member abutting said first stop lug with rotation of said drive shaft means to wind and lift said lifting strap, to move said setting strap and bring said slat into a first position;

said second stop member abutting said second stop lug with rotation of said drive shaft means to unwind and lower said lifting strap, to move said setting strap and bring said slat into a second position; and stop release means connected to said drive shaft means, operable with a full unwinding of said lifting strap to release said second stop member from said second stop lug to permit further movement of said setting member to bring said slat into a third position.

2. A venetian blind construction according to claim 1, including a cam lock connected to said strap engageable with said drive shaft means to stop movement of said setting strap when there is no rotation of said drive shaft means.

3. A venetian blind construction according to claim 1, wherein said stop release means comprises a pawl mounted for radial movement on said drive shaft means, a spring biasing said pawl outwardly into a position in which said pawl is engageable with said second stop member, said lifting strap wound over a portion of said pawl to move said pawl against bias of said spring and out of a position in which said pawl can be brought into abutment with said second stop member.

4. A venetian blind construction according to claim 3, wherein said drive shaft means comprises a drive shaft rotatably mounted in said housing, a drum connected to said drive shaft, said lifting strap wound on said drum, said drum including at least one end portion having circumferentially spaced teeth around which said setting strap is wound to form said coupling contact, said drum having a groove defined therein, a pin slidably mounted in said groove over which said lifting strap is wound, said spring biasing said pin radially outwardly in said groove, said pawl connected to said pin.

5. A venetian blind construction according to claim 4, wherein said drum comprises a pair of discs defining a channel in which said lifting strap is wound, said groove defined in at least one of said discs, said discs including at least one radially extending recess in which said pawl is slidably mounted, said spring comprising a leaf spring biasing said pin and pawl radially outwardly in said groove and radial recess.

6. A venetian blind construction according to claim 4, wherein, when said lifting strap is unwound from said drum, said leaf spring moves an end of said pawl radially outwardly beyond an outer periphery of said discs and into a position where a path of said end of said pawl abuts and dislodges said second stop member from said second stop lug.

7. A venetian blind construction according to claim 6, wherein said pin has an end extending axially outwardly beyond said groove, and reset cam means connected to said housing covering said drum and against which said pin end is engageable with rotation of said drum to move said pin against the bias of said leaf spring radially inwardly to disengage said pawl from said second stop member.

8. A venetian blind construction according to claim 7, wherein said reset means extend over substantially 180° of arc of said drum.

9. A venetian blind construction according to claim 1, including reset means connected to said housing abuttable with said stop release means for disengaging said stop release means from said second stop member when said drive shaft means is moved beyond a position in which said lifting strap is fully unwound and lowered.

10. A venetian blind construction according to claim 4, wherein said cam lock is shaped to engage into a groove between adjacent teeth on said drum end portion to block movement of said setting strap when there is no movement of said drum.

* * * * *